US006655680B1

(12) United States Patent
Huang et al.

(10) Patent No.: US 6,655,680 B1
(45) Date of Patent: Dec. 2, 2003

(54) DOCUMENT SENSOR AND SENSING METHOD

(75) Inventors: Yin-Chun Huang, Hsinchu (TW); Pi-Chun Chen, Changhua Hsien (TW); Ji-Mei Tsuei, Hsinchu (TW)

(73) Assignee: Umax Data Systems, Inc., Hsinchu (TW)

( * ) Notice: Subject to any disclaimer, the term of this patent is extended or adjusted under 35 U.S.C. 154(b) by 9 days.

(21) Appl. No.: 10/064,093

(22) Filed: Jun. 11, 2002

(51) Int. Cl.[7] ..... B65H 1/08

(52) U.S. Cl. ..... 271/152; 271/176; 271/199; 271/109; 209/600

(58) Field of Search ..... 271/207, 152, 271/176, 199, 3.06, 3.09, 9.06, 111, 227, 258.01, 3.17; 198/3.58; 209/600; B65H 31/00, 1/08, 43/00, 3/44, 7/08, 7/02

(56) References Cited

U.S. PATENT DOCUMENTS 4,449,705 A * 5/1984 Shibuya et al. ..... 271/9.09
4,451,030 A * 5/1984 Teeter et al. ..... 271/258.01
5,033,731 A * 7/1991 Looney ..... 271/176
5,653,434 A * 8/1997 Petocchi et al. ..... 271/122
5,743,522 A * 4/1998 Rubscha et al. ..... 271/265.02
5,897,112 A * 4/1999 Kwag ..... 271/38
5,964,460 A * 10/1999 Azumi et al. ..... 271/265.01

FOREIGN PATENT DOCUMENTS

JP 2002-249278 * 9/2002

* cited by examiner

*Primary Examiner*—Donald P. Walsh
*Assistant Examiner*—Kenneth W. Bower
(74) *Attorney, Agent, or Firm*—Jiang Chyun IP Office

(57) ABSTRACT

A sensor for detecting the entrance of a document into a sheet feeder. The document sensor is attached to the sheet feeder. The document sensor comprises a printed circuit board, a key peg and a rocking lever. The printed circuit board is attached to the sheet feeder. The printed circuit board has a first lead wire and a second lead wire detached form each other. The key peg is also attached to the sheet feeder pinning the rocking lever so that the rocking lever is free to rotate relative to the key peg. A conductive member is attached to the rocking lever so that rotating the rocking lever is able to establish an electrical connection between the first lead wire and the second lead wire through the conductive member.

19 Claims, 4 Drawing Sheets

DOCUMENT SENSOR AND SENSING METHOD

BACKGROUND OF INVENTION

1. Field of Invention

The present invention relates to the document sensor of a sheet feed scanner. More particularly, the present invention relates to a document sensor that can be fabricated at a considerably reduced cost.

2. Description of Related Art

Due to rapid progress in the electronic manufacturing industry, high performance computing systems are produced en-mass. With the proliferation of electronic products in the market, many of them are used in our daily life. In recent years, processing speed and storage capacity of computer products has also increased at a tremendous pace leading to higher performance for many types of graphic processors. Consequently, different types of image processing products such as optical scanners and digital cameras are constructed.

According to the document scanning method, optical scanners can be classified as belonging to: a packet scanner, a sheet feed scanner, a drum scanner or a flatbed scanner. As an example, a sheet feed scanner can have an optical resolution in excess of 600 dpi and almost all of them have a scanning structure that employs contact image sensors (CIS). In fact, the sheet feed scanner occupies such a small volume that they are routinely carried along with a notebook computer.

In general, a document sensor is installed on a sheet feed scanner so that the presence of any document in the sheet feeder can be detected. FIG. 1 is a front view showing a document sensing system in a conventional sheet feed scanner. As shown in FIG. 1, the document sensor 100 includes an optical sensor 110, a light emitter 120, a rocking lever 130 and a key peg 140. The optical sensor 110 and the light emitter 120 are attached to the sheet feeder (not shown) on each side of the rocking lever 130. The key peg 140 is also attached to the sheet feeder after passing through a hole in the rocking lever 130. Thus, the rocking lever 130 is free to rotate using the key peg 140 as a pivot. The light emitter 120 is positioned in such a way that a beam of light 122 from the light emitter 120 will go straight into the optical sensor 110 unimpeded.

Before a document (not shown) is fed into the sheet feeder, one end of the rocking lever 130 will cut across the path of the beam 122. Hence, the light beam 122 can never reach the optical sensor 110. Without receiving any light, the light sensor 110 will transmit a signal to a circuit chip (not shown) so that the chip jumps to a "no document" logic state.

FIG. 2 is a side view of the document sensing system in FIG. 1. When a document 150 is fed in direction 152 into the sheet feeder, the document 150 pushes the rocking lever 130 and swings its upper end to one side so that the light beam 122 is able to project straight ahead to the optical sensor 110 unimpeded. On picking up the light beam 122, the optical sensor 110 transmits another signal to the circuit chip so that the chip switches to a "document present" logic state.

As shown in FIGS. 1 and 2, the presence or absence of a document 150 in the sheet feeder depends on the light emitter 120/light sensor 110 system. The demand for a light emitter and a light sensor increases production cost of the optical scanner.

SUMMARY OF INVENTION

Accordingly, one object of the present invention is to provide a document sensor for a sheet feed scanner that does not require the incorporation of a light emitter and an optical sensor. Hence, overall production cost of the document sensing system is greatly reduced.

To achieve these and other advantages and in accordance with the purpose of the invention, as embodied and broadly described herein, the invention provides a document sensor for detecting the presence or absence of a document in a sheet feeder. The document sensor mounts on the sheet feeder. The document sensor at least includes a printed circuit board, a key peg and a rocking lever. The printed circuit board is attached to the sheet feeder. The printed circuit board contains a first lead wire and a second lead wire. The first lead wire and the second lead wire are separate from each other. The key peg passes through a hole in the rocking lever before attaching to the sheet feeder so that the rocking feeder may rotate using the key peg as a pivot. A conductive element is attached to the rocking lever so that the first lead wire and the second lead wire may be electrically connected together through a rotary motion of the rocking lever.

In one embodiment of this invention, the rocking lever has a linear shape and the conductive element is positioned at one end of the rocking lever. The conductive element may be an electroplated conductive layer on the rocking lever or a conductive plate attached to the rocking lever through rivets. Furthermore, the entire rocking lever may be made from a conductive material. One major design criteria of the rocking lever is the capacity to join up the first lead wire and the second lead wire selectively.

This invention also provides a method for sensing the presence or absence of a document inside a sheet feeder. The document sensing method includes the following steps. In step one, a document sensor is provided. The document sensor is attached to the sheet feeder. The document sensor comprises a first lead wire, a second lead wire and a driven element. The first lead wire and the second lead wire are detached from each other but are electrically connected together through the driven element. In step two, a document is fed into the sheet feeder. The entrance of a document pushes the driven element away from either the first lead wire or the second lead wire, breaking the electrical connection between the first and the second lead wire. Hence, the presence of a document in the sheet feeder can be detected. In step three, the document is pulled away from the sheet feeder. The driven element moves back to the original position and reforms the electrical connection between the first lead wire and the second lead wire. Hence, the absence of a document in the sheet feeder can be detected.

This invention also provides an alternative method for sensing the presence or absence of a document inside a sheet feeder. The document sensing method includes the following steps. In step one, a document sensor is provided. The document sensor is attached to the sheet feeder. The document sensor comprises a first lead wire, a second lead wire and a driven element. The driven element is detached at least from either the first lead wire or the second lead wire. In step two, a document is fed into the sheet feeder. The entrance of a document pushes the driven element to make an electrical connection between the first lead wire and the second lead wire. Hence, the presence of a document in the sheet feeder can be detected. In step three, the document is pulled away from the sheet feeder. The driven element moves back to the original position, breaking contact with at least either the first lead wire or the second lead wire again. Hence, the absence of a document in the sheet feeder can be detected.

In brief, by attaching a conductive element to the rocking lever or fabricating the rocking lever with conductive material, an electrical connection or disconnection between the first lead and the second lead wire can be selected through a rotation. Ultimately, internal logic states of a silicon chip can be controlled. The document sensing system has a simple structure and circuit design and hence the production cost is low.

It is to be understood that both the foregoing general description and the following detailed description are exemplary, and are intended to provide further explanation of the invention as claimed.

BRIEF DESCRIPTION OF DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DETAILED DESCRIPTION

Figure 1:
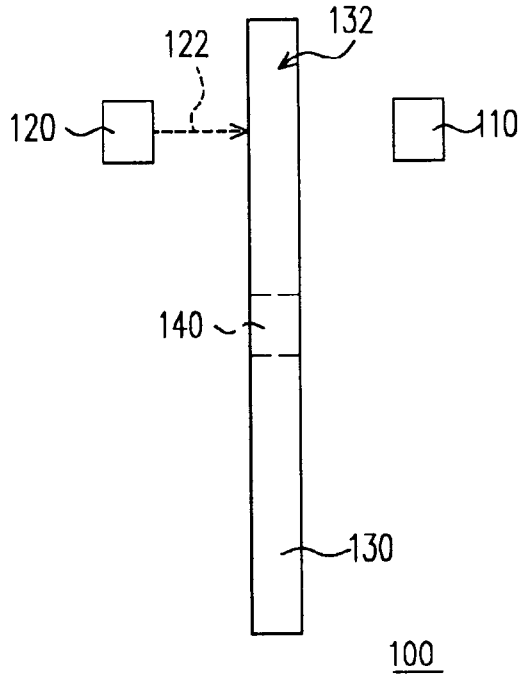
FIG. 1 (PRIOR ART)
FIG. 1 is a front view showing a document sensing system in a conventional sheet feed scanner.
Figure 2:
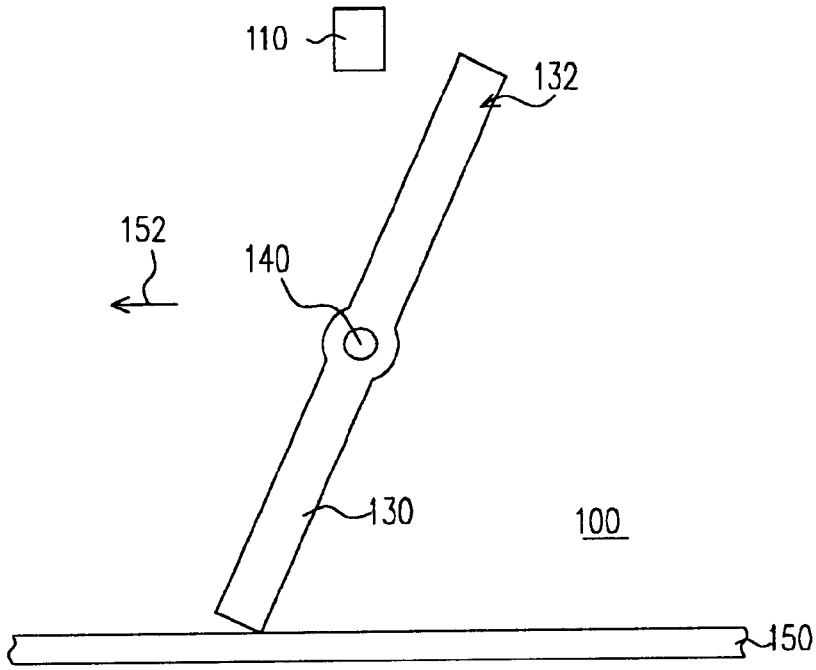
FIG. 2 (PRIOR ART)
FIG. 2 is a side view of the document sensing system in FIG. 1.

Reference will now be made in detail to the present preferred embodiments of the invention, examples of which are illustrated in the accompanying drawings. Wherever possible, the same reference numbers are used in the drawings and the description to refer to the same or like parts.

Figure 3:
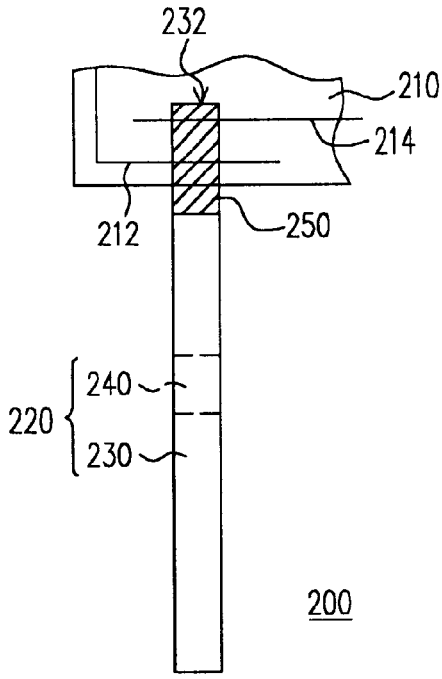
FIG. 3 is a front view showing a document sensing system in a sheet feeder according to one preferred embodiment of this invention.

FIG. 3 is a front view showing a document sensing system in a sheet feeder according to one preferred embodiment of this invention. The document sensor 200 in FIG. 3 is used for detecting the entrance of a document (not shown) into a sheet feeder (not shown). The document sensor 200 is mounted on the sheet feeder. The document sensor 200 comprises a printed circuit board 210 and a driven element 220. The printed circuit board 210 is attached to the sheet feeder. The printed circuit board 210 at least includes a first lead wire 212 and a second lead wire 214. The first lead wire 212 and the second lead wire 214 are detached from each other. That means the first lead wire 212 and the second lead wire 214 are electrically isolated. The driven element 220 comprises a rocking lever 230 and a key peg 240. The key peg 240 passes through a hole in the rocking lever 230 before attaching to the sheet feeder so that the rocking lever 230 is free to rotate using the key peg 240 as a central pivot. The rocking lever 230 has a linear shape. A conductive member 250 (shaded portion in the figure) is attached to one end 232 of the rocking lever 230. The conductive member 250 is a conductive layer formed on the surface of the rocking lever 230 either by electroplating or by riveting. Through rotation of the rocking lever 230, the first lead wire 212 and the second lead wire 214 may be electrically connected or separated by moving the conductive member 250 towards or away from the lead wires 212 and 214 through rocking motion of the lever 230.

Before the entrance of a document (not shown) into the sheet feeder, the first lead wire 212 and the second lead wire 214 are electrically connected together through the conductive path 250. Since a closed circuit is formed through the wires 212 and 214, a circuit chip connected to the wires 212 and 214 will jump to a "no document" logic state.

Figure 4:
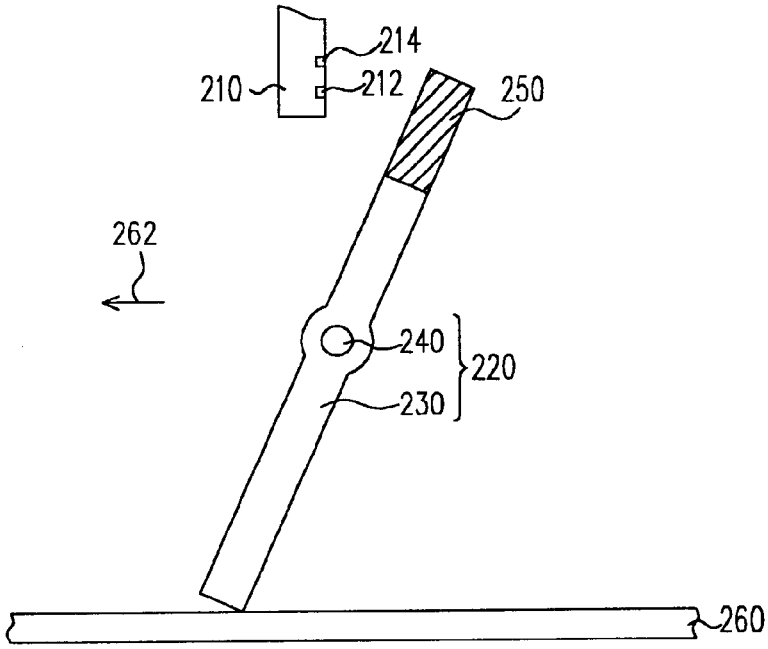
FIG. 4 is a side view of the document sensing system in FIG. 3.

FIG. 4 is a side view of the document sensing system in FIG. 3. When a document 260 is fed into the sheet feeder in direction 262, the document 260 pushes the rocking lever 230 and moves the conductive member 250 away from the first lead wire 212 and the second lead wire 214. Hence, an open circuit is formed between the first lead wire 212 and the second lead wire 214. The breaking of the circuit will initiate a signal that informs the circuit chip to jump to a "contain document" logic state.

As shown in FIGS. 3 and 4, this invention relies on the attachment of a conductive member 250 to the rocking lever 230 and the selective breaking of electrical connection between the first lead wire 212 and the second lead wire 214 through rotation to signal a change of logic state inside a circuit chip. This type of document sensor 200 has a simple structural design and uses a simple circuit. Hence, fabrication cost of the sensor is low.

Figure 5:
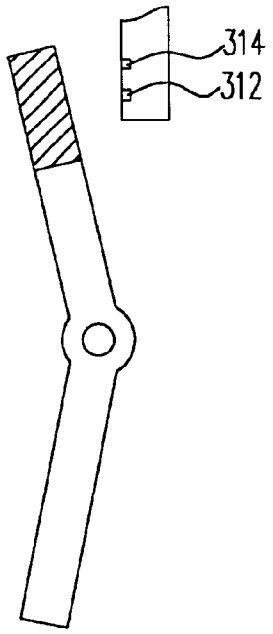
FIGS. 5 and 6 are side views showing the positions of a rocking lever inside a document sensing system according to a second preferred embodiment of this invention.
Figure 6:
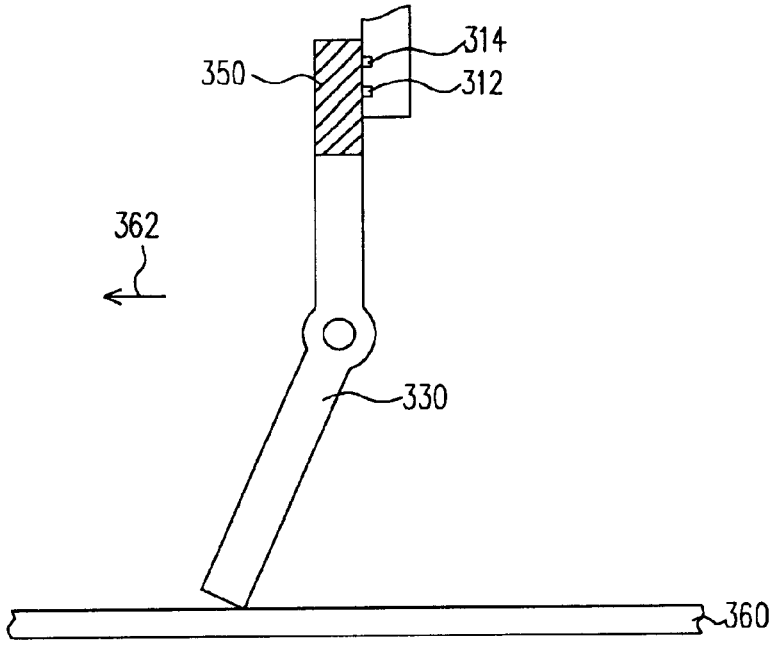

In the first embodiment, conduction between the first lead wire and the second lead wire indicates a "document absent" logic state while an open circuit between the first and the second lead wire indicates a "document present" logic state. However, the aforementioned configuration of the logic states is not the only permissible one. logic states may also be used to control the circuit chip. FIGS. 5 and 6 are side views showing the positions of a rocking lever inside a document sensing system according to a second preferred embodiment of this invention.

As shown in FIG. 5, before the passing of a document into the sheet feeder, the first lead wire 312 and the second lead wire 314 are in an open circuit state. Hence, the circuit chip will jump to a "no document" logic state. On the other hand, when a document 360 is fed into the sheet feeder in direction 362 as in FIG. 6, the document 360 pushes the rocking lever 330 to make an electrical connection between the first lead wire 312 and the second lead wire 314. Hence, a closed circuit is formed and the circuit chip will switch to a "document present" logic state.

In the aforementioned embodiments, a conductive member is attached to the rocking lever by electroplating or riveting. However, this invention also permits the entire rocking lever to be made from a conductive material so that the first lead wire and the second lead wire may be electrically connected through motion of the rocking lever.

Figure 7:
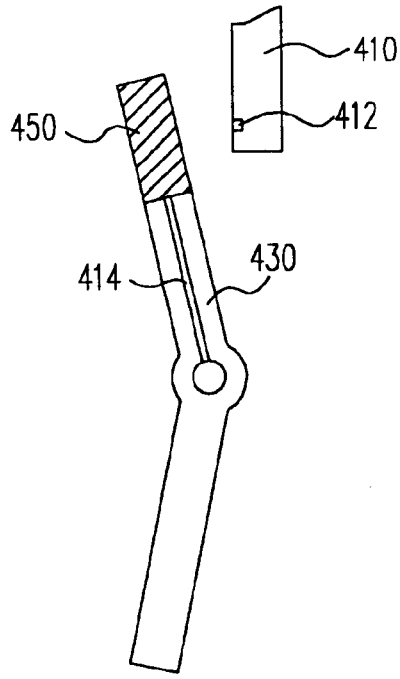
FIGS. 7 and 8 are side views showing the positions of a rocking lever inside a document sensing system according to further another preferred embodiment of this invention.
Figure 8:
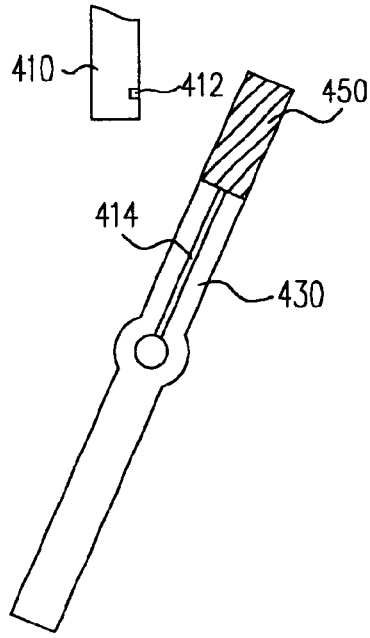

Furthermore, in the foregoing embodiments, the first lead wire and the second lead wire are disposed on a printed circuit board. However, the invention is not limited in the foregoing applications. As shown in FIGS. 7 and 8, they are side views showing the positions of a rocking lever inside a document sensing system according to another preferred embodiment of this invention. The first lead wire 412 is disposed on the printed circuit board 410 but the second lead wire 414 is disposed on the rocking lever 430. The second lead wire 414 is electrically connected to the conductive members 450, so that when the rocking lever 430 is rotated to printed circuit board 410, the conductive members 450 would cause the first lead wire 412 and the second lead wire 414 to be connected. Then, it can be judged whether or not the sheet is fed into the sheet feeder. The method to judge it is similar as foregoing descriptions and is not further described here. The method using the structure as shown in FIG. 7, to judge whether or not the sheet is fed into the sheet feeder can refer to the descriptions for FIGS. 5 and 6. The method using the structure as shown in FIG. 7, to judge whether or not the sheet is fed into the sheet feeder can refer to the descriptions for FIGS. 3 and 4.

In conclusion, this invention relies on the attachment of a conductive member to the rocking lever and the selective breaking of electrical connection between a first lead wire and a second lead wire through rotation to signal a change of logic state inside a circuit chip. This type of document sensor has a simple structure and employs a simple control circuit. Hence, fabrication cost of the sensor is considerably lower than the conventional light emitter/optical sensor system.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A document sensor attached to a sheet feeder for sensing the presence of a document, comprising:

a first lead wire;

a second lead wire electrically separated from the second lead wire;

a key peg attached to the sheet feeder; and a rocking lever pinned by the key peg such that the rocking lever is free to rotate using the key peg as a pivot, and the first lead wire and the second lead wire can be electrically connected through a rotation of the rocking lever.

2. The document sensor of claim 1, wherein the rocking lever has a linear shape with a conductive member and the conductive member is attached to one end of the rocking lever, wherein the first lead wire and the second lead wire can be electrically connected via the conductive member.

3. The document sensor of claim 1, wherein the rocking lever has a conductive member, and the conductive member is formed on the surface of the rocking lever by electroplating, wherein the first lead wire and the second lead wire can be electrically connected via the conductive member.

4. The document sensor of claim 1 wherein the rocking lever has a conductive member, and the conductive member is attached to the rocking by riveting, wherein the first lead wire and the second lead wire can be electrically connected via the conductive member.

5. The document sensor of claim 1, wherein the first lead wire and the second lead wire are disposed on a printed circuit board.

6. The document sensor of claim 1, wherein the first lead wire is disposed on a printed circuit board, and the second lead wire is disposed on the rocking lever and has electrical connection with a conductive member.

7. A document sensor attached to a sheet feeder for sensing the presence of a document, comprising:

at least a lead wire; and a driven element capable of selectively electrical connecting to the lead wire, so as to judge whether or not the document has entered the sheet feeder.

8. The document sensor of claim 7, wherein the driven element further includes a conductive member attached to its surface by electroplating and capable of connecting up the lead wire electrically when the driven element is selected.

9. The document sensor of claim 7, wherein the driven element further includes a conductive member attached to its surface by riveting and capable of connecting up the lead wire electrically when the driven element is activated.

10. The document sensor of claim 7, comprising two lead wires and a printed circuit board, wherein one of the two lead wires is disposed on the printed circuit board and the other one of the two lead wires is disposed on the driven element, so that can be selectively electrical connection with the one of the two lead wires disposed on the printed circuit board.

11. The document sensor of claim 7, comprising two lead wires and a printed circuit board, wherein the two lead wires are disposed on the printed circuit board.

12. A method of sensing the entrance of a document into a sheet feeder, comprising the steps of:

providing a document sensor and attaching the document sensor to the sheet feeder, wherein the document sensor includes:

at least a lead wire; and a driven element for connecting the lead wire electrically;

feeding a document into the sheet feeder, pushing the driven element such that the driven element is separated from the lead wire, so as to judge whether or not the document has entered the sheet feeder; and removing the document from the sheet feeder, whereby the lead is electrically connected to the driven element, so as to judge whether or not the document has entered the sheet feeder.

13. The document sensor of claim 12, wherein the driven element includes a tumbler and a rocking lever, the tumbler is disposed on the sheet feeder, and the rocking lever is implemented on the tumbler, so that the rocking lever can rotate using the tumbler as a rotation center, wherein the rocking lever further includes a conductive member, the conductive member is disposed on the rocking lever, whereby when the rocking lever rotates, the conductive member can selectively connected to the lead wire by electrical connection.

14. The document sensor of claim 13, wherein the document sensor includes two lead wires and a printed circuit board, one of the two lead wires is disposed on the printed circuit board and the other one of the two lead wires is disposed on the driven element, so that can be selectively electrical connection with the one of the two lead wires disposed on the printed circuit board.

15. The document sensor of claim 12, wherein the document sensor includes two lead wires and a printed circuit board, the two lead wires are disposed on the printed circuit board.

16. A sensing method for detecting the entrance of a document into a sheet feeder, comprising the steps of:

providing a document sensor and attaching the sensor to the sheet feeder, wherein the sensor comprising:

at least a lead wire; and a driven element, which is separated from the lead wire;

feeding a document into the sheet feeder, pushing the driven element such that the driven element is electrically connected to the lead wire, so as to judge whether or not the document has entered the sheet feeder; and removing the document from the sheet feeder, whereby the lead is separated from the driven element, so as to judge whether or not the document has entered the sheet feeder.

17. The document sensor of claim 16, wherein the driven element includes a tumbler and a rocking lever, the tumbler is disposed on the sheet feeder, and the rocking lever is implemented on the tumbler, so that the rocking lever can rotate using the tumbler as a rotation center, wherein the rocking lever further includes a conductive member, the conductive member is disposed on the rocking lever, whereby when the rocking lever rotates, the conductive member can selectively connected to the lead wire by electrical connection.

18. The document sensor of claim 17, wherein the document sensor includes two lead wires and a printed circuit board, one of the two lead wires is disposed on the printed circuit board and the other one of the two lead wires is disposed on the driven element, so that can be selectively electrical connection with the one of the two lead wires disposed on the printed circuit board.

19. The document sensor of claim 16, wherein the document sensor includes two lead wires and a printed circuit board, the two lead wires are disposed on the printed circuit board.

* * * * *